US005471905A

United States Patent [19]

Martin

[11] Patent Number: 5,471,905

[45] Date of Patent: Dec. 5, 1995

[54] ADVANCED LIGHT ARMOR

[75] Inventor: Patrick L. Martin, Thousand Oaks, Calif.

[73] Assignee: Rockwell International Corporation, Seal Beach, Calif.

[21] Appl. No.: 84,901

[22] Filed: Jul. 2, 1993

[51] Int. Cl.[6] ..... F41H 5/04

[52] U.S. Cl. ..... 89/36.02; 109/49.5; 109/84

[58] Field of Search ..... 89/36.01, 36.02; 428/911; 109/49.5, 80, 84

[56] References Cited

U.S. PATENT DOCUMENTS

| | | | |
|---|---|---|---|
| 2,399,691 | 5/1946 | Patriot | 89/36.02 |
| 3,616,115 | 10/1971 | Klimmek | 109/84 |
| 3,765,299 | 10/1973 | Pagano et al. | 89/36.02 |
| 3,969,563 | 7/1976 | Hollis, Sr. | 428/911 |
| 4,161,125 | 7/1979 | Degnan | 428/911 |
| 4,499,156 | 2/1985 | Smith et al. | 428/614 |
| 4,859,541 | 8/1989 | Maxeiner et al. | 428/911 |
| 5,102,723 | 4/1992 | Pepin | 89/36.02 |

FOREIGN PATENT DOCUMENTS

| | | | |
|---|---|---|---|
| 9209861 | 6/1992 | WIPO | 89/36.02 |

*Primary Examiner*—Stephen M. Johnson
*Attorney, Agent, or Firm*—Terrell P. Lewis; Lawrence N. Ginsberg; Charles T. Silberberg

[57] ABSTRACT

A structural armor component includes opposing face sheets and a multi-cell core having abrasive materials disposed within the cells of the core. The face sheets and the core are fabricated from a tough titanium alloy. The core is preferably of honeycomb or truss-core configuration, and the abrasive materials are provided as a loose, particulate material, a sintered powder, or a particulate or powder embedded in polymer matrix. The "outer" face sheet slows travel of a projectile, while the abrasive materials within the core act to erode and ultimately cause disintegration of the projectile(s) before the latter can penetrate the opposite "inner" face sheet.

4 Claims, 1 Drawing Sheet

ADVANCED LIGHT ARMOR

BACKGROUND OF THE INVENTION

1. Field of the Invention

The present invention relates to armor materials, and more particularly to a light-weight, high strength structural armor member for improving the capability of such armor members to resist penetration by high-speed projectiles.

2. Background of the Invention

Conventional armor is typically made of ceramic materials, metallic materials or a combination of the two. An example of conventional armor, shown in U.S. Pat. No. 4,404,889 to Miguel, includes layers of high density steel honeycomb, balsa wood, and ballistic resistant nylon sandwiched in various arrangements between outer layers of steel armor plate.

Ceramic materials offer significant efficiency in defeating armor piercing projectiles at the lowest weight per square foot of surface area. The ceramic armor sections are generally mounted on a tough support layer such as glass reinforced plastics. Boron carbide, silicon carbide and alumina are ceramics which are commonly used in armor plating.

However, ceramic plates have the serious drawback of being unable to sustain and defeat multiple hits by armor piercing projectiles. Because relatively large sections of ceramic material must be used to stop these projectiles and because these sections shatter completely when hit by a projectile, the ceramic armor is unable to defeat a second projectile impacting close to the preceding impact. Moreover, sympathic shattering of adjacent ceramic sections usually occurs, still further increasing the danger of penetration by multiple rounds.

In addition, ceramic armors are difficult and costly to manufacture; not only are very high manufacturing temperatures required, but also processing is time consuming because very slow cooling is necessary to avoid cracking.

Metallic materials have been implemented for light weight armor applications because they possess excellent ability to defeat multiple, closely spaced impacts of armor piercing projectiles. However, this class of materials is often far heavier than desired and difficult to fabricate into intricate contours. Moreover, the weight of metallic materials has typically precluded its extensive use in such light-weight mobile weapons systems as helicopters and small water craft.

While neither of these materials systems, by itself, can achieve the results of the other, heretofore their implementation in combination has also failed to achieve the totality of desired results.

OBJECTS OF THE INVENTION

It is therefore a principal object of the present invention to provide a novel light-weight, high strength structural member offering improved penetration resistance for ballistic projectiles, which will combine all the properties and advantages of ceramic and metallic material systems, while also overcoming all the disadvantages and drawbacks of similar conventional structures.

Another object of the present invention is to provide a structural member including a truss-core sandwich element housing armor protection materials within the sandwich element channel openings.

Still another object of the invention is to provide a structural truss core member of light-weight, high-strength titanium alloy which has been ballistically enhanced by the placement of penetration resistant materials within the truss core.

These and other objects are accomplished by providing a structural sandwich member including opposing face sheets and a multi-cell core having abrasive materials disposed within the cells of the core. The face sheets and the core are fabricated from a tough titanium alloy. The core is preferably of honeycomb or truss-core configuration, and the abrasive materials are provided as a loose, particulate material, a sintered powder, or a particulate or powder embedded in polymer matrix. The "outer" face sheet acts to deter penetration of a projectile, but in the event such penetration takes place, the abrasive materials within the core act to erode and ultimately cause disintegration of the projectile(s) before the latter can penetrate the opposite "inner" face sheet.

BRIEF DESCRIPTION OF THE DRAWING

The sole FIGURE is a perspective view of one embodiment of the structural member of the present invention which functions as the armor element.

DETAILED DESCRIPTION OF THE INVENTION

Figure 1:
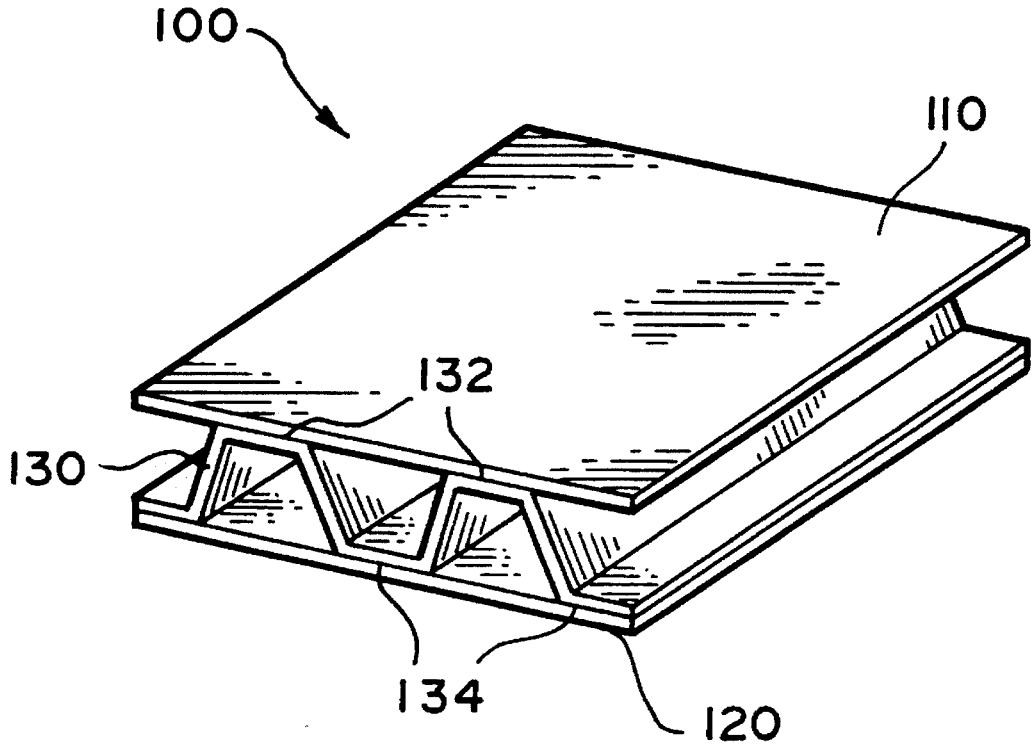

Referring now to the FIGURE, the structural member 100 includes a first face sheet 110, a second face sheet 120 and a core element 130 (shown here as a truss-core configuration). Either one of the two face sheets shown here might be considered the "outer" face sheet, in which case, the other of the face sheets would be considered the "inner" face sheet. For purposes of discussion, reference is made to face sheet 110 as the "outer" face sheet and to face sheet 120 as the "inner" face sheet.

Each of the face sheets and the core element comprise a high toughness, high strength titanium alloy, such as Ti-6Al-4V or Corona 5, with the latter material being the preferred material. The composition of Corona 5 titanium alloy is 4.5 wt. % Al, 5 wt. % Mo, and 1.5 wt. % Cr, with the remainder being titantium.

Each of the face sheets of the structural member 100 has some resistance to puncture by projectiles. However, the tendency of titanium to fail by adiabatic shear bands, leading to "plugging" of the material about the diameter of the incoming projectile, is improved by the insertion of abrasive materials into the cells of the core element. These materials may be provided in the form of abrasive ceramic particulates (which are able to change the shape of the projectile following its penetration of the outer face sheet) or a woven fabric of abrasive fibers such as the woven fabric material known as KEVLAR® (which absorb energy from the projectile after the latter has penetrated the outer face sheet). In either case, the core sheet 130 and/or the inner face sheet 120 will be sufficient to stop or significantly decelerate the incoming projectile such that it will be rendered ineffective in accomplishing further penetration or structural damage.

In contrast to conventional armor structures, space and weight in the armor element of the present invention are reduced since the interior volume delimited by the cells within the core element are unoccupied. Moreover, conventional armor structures include parasitic panels or drapes attached to the inner or outer surfaces of the load bearing structure; thus, these parasitic components are not incorporated within the armor element.

The abrasive materials contemplated by the present invention include hard ceramic materials, such as BN, BC, $Al_2O_3$, TiC, SiC, etc. These materials could be provided in loose form, but would be most effective in the form of angular particles partially or fully sintered and combined with a binder for application to the empty cells in the core element. This would be accomplished by consolidating the particle/binder composition to near-net shape (or machining it) to fit within the internal configuration of the cells via insertion along the axis of the core element after final shaping. The materials could be held in place using polymer binders which would have the advantage in manufacturing of being injected as a liquid or paste into the panel after the latter has been fastened.

The invention also contemplates filling the voids with conventional energy absorbing armor materials, such as the woven fabric material known as KEVLAR®.

The structural members made according to the present invention, as described above, exhibit the following beneficial characteristics:

(1) a weight-efficient, stiff structure;

(2) a high load-carrying capability;

(3) armor plating having a greater projectile penetrating resistance than the penetrating resistance of the metal itself;

(4) sustained damage tolerance, following penetration of the outer face sheet by one or more projectiles, due to the high toughness of the titanium alloy.

Several additional factors might improve the performance of the light-weight structural member 100 of the invention.

First, when member 100 is being designed, one of the considerations is the maximum diameter of projectile which is thought to be encountered. In the design process, the width of the lands 132,134 of the truss-core element 130 (where diffusion bonded to the face sheets) should be chosen to be smaller than the projectile maximum diameter, and especially the diameter of the face of such a projectile which has emerged after being flattened on impact with the outer face sheet. In this way, the truss core would help support the face sheet during the initial impact by the projectile.

Second, the energy-absorbing filler material properties should be chosen appropriately insofar as they can affect the overall performance of the metal in the core element. For example, very stiff and brittle filler material, though abrasive, might not allow metal deformation and thereby maximize energy absorption. On the other hand, too soft a filler would lead to a "flowing" of the abrasive material away from the bulge during penetration of the projectile. An intermediate value of pliability of the filler material would provide the optimum results.

Third, the density of the filler material (i.e., the ceramic abrasive material and the binder) will dramatically affect the weight of the armor. High volume fraction of low density angular particles will provide the best results.

While certain representative embodiments and details have been shown for the purpose of illustrating the invention, it will be apparent to those skilled in this art that various changes and modifications may be made therein without departing from the spirit or scope of this invention.

What we claim is:

1. An improved armor, comprising:

first and second face sheet members and a structural load-carrying core element disposed between the face sheet members, said face sheet members being disposed parallel to one another and being made of a high-strength, high-toughness titanium alloy, abrasive filler material disposed between said face sheets for eroding a projectile which has penetrated one of the face sheets, said filler material being chosen from the class of ceramic materials consisting of BN, BC, $Al_2O_3$, TiC, KEVLAR® and SiC, wherein said core element includes channel-defining members, and said filler material is a woven fabric armor material disposed within adjacent ones of said channel-defining members.

2. The improved armor of claim 1, wherein said high-strength, high-toughness titanium alloy comprises CORONA 5.

3. The improved armor of claim 2, wherein said core element comprises CORONA 5.

4. A non-parasitic structural armor element, comprising:

a load-carrying sandwich member including first and second parallel face sheets and a core element disposed between and bonded to the face sheets, said face sheets comprising Corona 5 titanium alloy, and abrasive filler material disposed within said core element for deterring passage of a projectile, which has punctured one of the face sheets, through said core element, wherein said filler material comprises a woven cloth of abrasive fiber material.

* * * * *